United States Patent [19]

Gustavsson

[11] 4,411,188

[45] Oct. 25, 1983

[54] DEVICE FOR SPEED CONTROL OF CYLINDER PISTON, PARTICULARLY USEFUL FOR A FIREARM

[75] Inventor: Olle Gustavsson, Karlskoga, Sweden

[73] Assignee: Aktiebolaget Bofors, Bofors, Sweden

[21] Appl. No.: 217,598

[22] Filed: Dec. 18, 1980

[30] Foreign Application Priority Data

Dec. 18, 1979 [SE] Sweden ..... 7910400

[51] Int. Cl.[3] ..... F41F 11/07

[52] U.S. Cl. ..... 89/20 A; 91/405; 91/410

[58] Field of Search ..... 89/20 A, 47; 91/405, 91/410, 448

[56] References Cited

U.S. PATENT DOCUMENTS 2,379,180 6/1945 Pohl ..... 89/47

3,186,307 6/1965 Ellenbogen ..... 91/448

FOREIGN PATENT DOCUMENTS 630730 11/1961 Canada ..... 91/405

913891 12/1962 United Kingdom ..... 91/405

139524 7/1960 U.S.S.R. ..... 91/405

*Primary Examiner*—Stephen C. Bentley

*Attorney, Agent, or Firm*—Pollock, Vande Sande & Priddy

[57] ABSTRACT

In a device for achieving speed control of a cylinder piston in relation to the cylinder, or vice versa, flow control means (12, 32) are utilized, and also cam profiles (15, 16 and 26, 27). The flow control means are composed of two constant flow valves (30*a*, 30*b* and 31*a*, 31*b*) which determine the flow for one each of the directions of the piston or the cylinder. The cam profile means have a first cam profile (15 and 26, respectively) which is connected when the piston (6) or the cylinder (5) moves in its first direction, and a second cam profile (16 and 27, respectively) which is connected when the piston or cylinder moves in its second direction. The flow control valves are controlled mechanically by the respective cam profiles via its respective control input (12*c*', 12*c*'') and determine a flow for the piston or cylinder which is dependent on the controlling but independent of the load on the piston or the cylinder.

5 Claims, 7 Drawing Figures

DEVICE FOR SPEED CONTROL OF CYLINDER PISTON, PARTICULARLY USEFUL FOR A FIREARM

TECHNICAL FIELD

The present invention relates to a device for achieving speed control of a cylinder piston in relation to the cylinder, or vice versa, particularly useful for a firearm, and utilizing flow control means which have a mechanical control input and which provides the cylinder piston with a flow which is dependent on the control input but independent of the load on the piston. Cam profile means are provided for actuating the control input for achieving control. The invention is then applicable also in cases when both the piston and the cylinder are movably arranged in relation to each other.

BACKGROUND ART

For the closing mechanism and ramming means on artillery pieces and the like it is previously known to achieve speed controlled movements of a screw breech mechanism or a ramming car with the aid of a so-called constant flow valve and a controlling cam profile means. For the known arrangement it has then been proposed to utilize four non-return valves arranged in a bridge connection which ensure that operating flow through the valve can be conducted in the same direction through the valve during both directions of movement of the piston.

The known arrangement has required a comparatively large space on the firearm, and, therefore there has been a need for equipment which requires less space. Requirements continuously remain within weapons development for simplified function and design of the various parts of the weapons.

SUMMARY OF THE INVENTION

The purpose of the present invention is to create a device which solves the above-mentioned problems, and the new device has flow control means which comprise two constant flow valves arranged to determine the flow for each of the directions of the cylinder piston or the cylinder. The cam profile means have a first cam profile which determines the control for the first direction of the piston or the cylinder and a second cam profile which determines the control of the second direction of the piston or the cylinder.

In further developments of the concept of the invention further indications are proposed as to how the coaction between the control input and the two cam profiles should be accomplished with the aid of specific transfer means, and the details of the design of the latter. It is also taught how the device itself should be designed, and details are given of how the device should be used particularly for the closing and ramming functions of the firearm.

However, the features that can mainly be considered to be characteristic for a device according to the invention will be noted from the following claims.

In addition to obtaining an integrated solution of the speed controlling functions of a hydraulic piston, a reliably functioning and technically simple design is obtained, which eliminates the need for frequent service intervals.

BRIEF DESCRIPTION OF DRAWINGS

An embodiment proposed at present of a device which has the characteristics significant for the invention will be described in the following, with reference to the accompanying drawings, in which.

BEST MODE OF CARRYING OUT THE INVENTION

Figure 1:
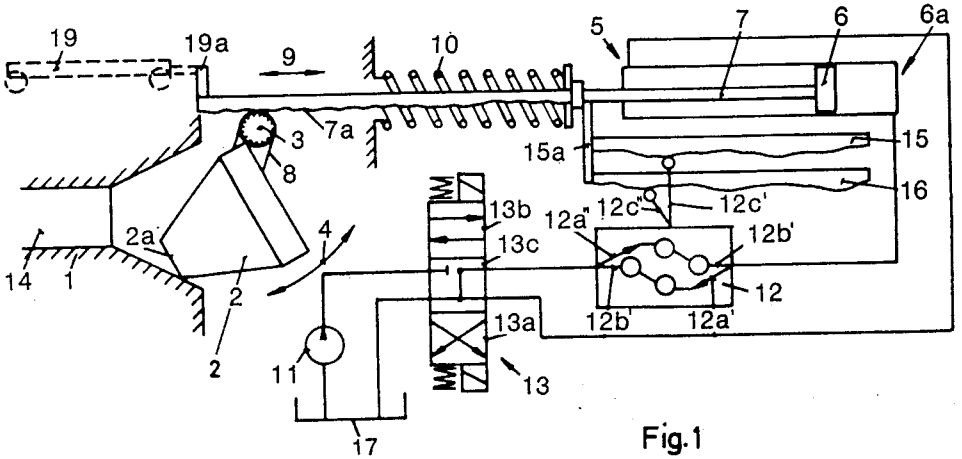
FIG. 1 shows schematically a speed controlling arrangement for a hydraulic piston used for a firearm which is only shown symbolically for control of the closing mechanism or the ramming means for the firearm, FIG. 2 in a side view and partly in cross-section shows parts of a practical embodiment of a hydraulic cylinder with cam profiles for a closing mechanism on a field howitzer, FIG. 3 in cross-section along the section line A—A in the hydraulic cylinder according to FIG. 2 shows the designs of the hydraulic cylinder and the cam profiles in the section.

In FIG. 1, parts of a breech ring, belonging to e.g. a field howitzer which is known in itself, are indicated by the numeral 1. At the breech ring in question there is arranged a closing mechanism, also known in itself, comprising a screw 2 which is arranged so that it can be swung at the rear parts of the breech ring in its upper parts in a symbolically indicated support 3. The screw 2 can be swung in the direction of the arrows 4 between an open and a closed position, and in FIG. 1 an intermediate position is shown.

For a certain type of field howitzer there is a desire to be able to apply a bag charge or other powder charge, not shown, behind a shell, not shown, in the chamber 14. It is then of importance, regardless of the length of the bag charge, which can vary in different firing cases, and the distance between the rear surface of the projectile and the front part of the bag charge or, in the case when a plurality of bag charges is used, the front part of the front bag charge, to be able to place the rear parts of the bag charge in question at the inner surface 2*a* of the screw 2 when the screw is in the closed position. This requires that the screw not be allowed to give the bag charge lying inside a hard push when it is swung into its closed position in the breech ring. This, in turn, requires the screw to have a rather low closing speed just before it reaches the closed position. As the closing function moreover must take place comparatively rapidly, this requires that the screw have varying speeds during its closing process, and also that the speeds during the closing process differ from those which should prevail during the opening process, when the conditions are different.

The closing and opening movements of the screw 2 are controlled with the aid of an operating cylinder 5 which works with hydraulic oil, in a known way. The operating cylinder is equipped with a piston 6 and a piston rod 7 which at its outer end is made with a row of teeth 7*a*, which is only partly shown. The piston rod coacts via its teeth with a gear 8, with which the support 3 for the screw 2 is connected together, so that the swinging movements of the screw are obtained through the longitudinal displacement movements of the gear rack in the directions of the arrows 9. The hydraulic piston has a helical spring 10 which strives to press the piston towards a starting position which is indicated by 6*a*. In the starting position 6*a* the piston rod 7 holds the screw in its closed position.

The piston 6 is actuated against the action of the spring 10 to its second end position by means of hydraulic oil from a source of pressure 11 and via, inter alia, flow control means 12 which are arranged fixed in relation to the piston. The flow control means have two inputs 12*a*′ and 12*a*″ and two outputs 12*b*′ and 12*b*″. Between the source of pressure 11 and the flow control means there is also arranged a valve for determining the direction of the flow, or a flow-directing valve 13, which is arranged so that it can be actuated by means which sense the function utilized at the firearm for the loading cycle. The valve 13 consists of a three-position four-way valve of a known kind. The valve assumes the position 13*a* when the screw is to be closed and the position 13*b* when the screw is opened. It can also assume the position 13*c* in the initial stage of the closing and opening movements.

The flow control means 12 are also provided with a control input comprising two separate control means 12*c*′ and 12*c*″, which are arranged in coaction each with its cam profile 15 and 16, respectively. The latter are connected to the movements of the piston rod 7 and will thus be moved past the flow control means which is arranged fixed in relation to the piston. The connections between the cam profiles 15 and 16 and the piston rod are indicated by 15*a*. A draining tank is indicated by 17.

The arrangement described above functions in the following way, and it is then assumed that the screw 2 is being closed and the valve 13 assumes the position 13*a*. The spring 10 presses the piston against the starting positions 6*a*, and therefore hydraulic oil is conducted away from the underside of the piston 6 and in on the input 12*a*′ of the flow control means 12 and thereafter out via the output 12*b*′ of the same means to the tank 17 via the valve 13. As described below, the means 12*c*′ and 12*c*″ are arranged so that the cam profile 15 controls the control input of the flow control means during this direction of movement of the hydraulic piston. The flow control means give a speed variation of the movement of the piston which is determined by the cam profile 15 and which will moreover be independent of the load on it, due to the flow control means.

When the screw in the starting position 6*a* of the piston has been closed, the round of ammunition in question can be fired, and thereafter means sensing the loading cycle can actuate the valve 13 to the position 13*b* where the source of pressure via the input and output 12*a*″ and 12*b*″ of the flow control means of said position 13*b* of the valve is connected to the piston 6 from the side facing the rod, the so-called piston side, so that the piston is actuated towards its second end position against the action of the spring 10, and then opens the screw 2. As indicated below, the control means 12*c*′ and 12*c*″ are arranged so that the cam profile 16 controls the controlling of the flow control means during the last-mentioned direction of movement of the hydraulic piston. In this case the flow control means achieve a speed variation of the movements of the piston, determined by the cam profile 16, but also in this case the outward flow will be independent of the load on the piston, due to the flow control means. When the piston has reached its second end position and new loading of the firearm has taken place, the valve 13 will be actuated anew, etc.

As an alternative to the control of the screw 2, the ramming function of the firearm can be controlled by means of the piston in the corresponding way, and the ramming function in FIG. 1 is then symbolized by a ramming car 19 connected to the piston rod via a connection 19*a*, which is known.

Figure 2:
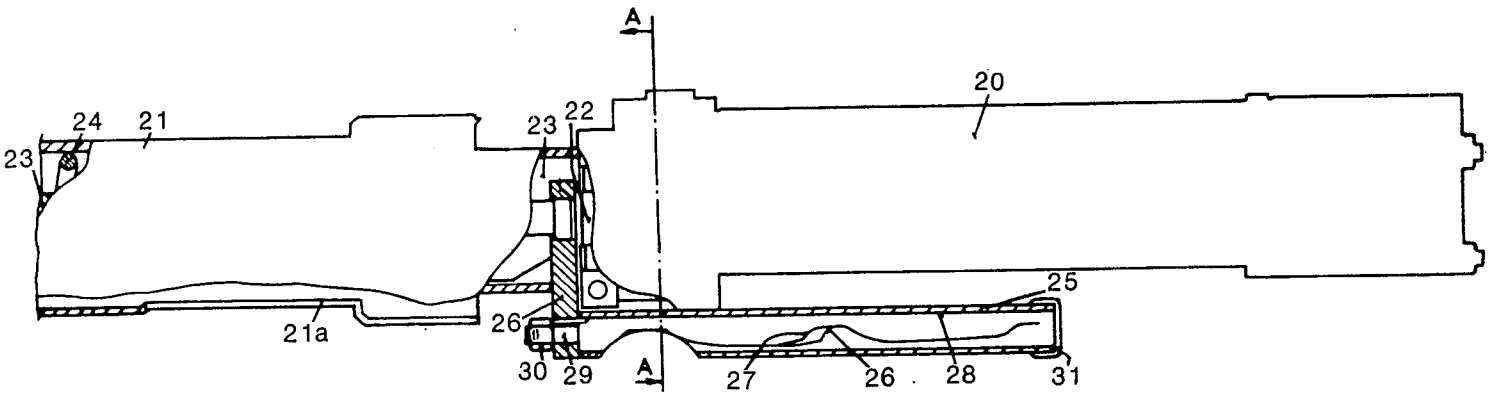
Figure 3:
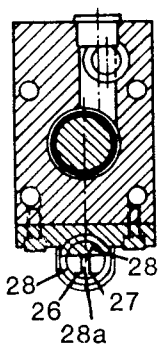

FIG. 2 is intended to show a practical example of the embodiment of an operating cylinder for a closing mechanism comprising a screw on a field howitzer, and only the parts concerned by the present invention are described. The hydraulic cylinder comprises two cylinder parts 20 and 21. In the first cylinder part there is arranged a piston which can be displaced by means of hydraulic oil, in a way which is known in itself, the piston rod of which is indicated by 22 in FIG. 2. The cylinder part 21 comprises a connection part 23 which connects the piston rod and a gear rack. The connection part can be displaced by means of the piston rod in the cylinder part 20 by an end surface on the piston rod 22 coacting with a corresponding end surface of the connection part 23. A return spring 24 (corresponding to the spring 10 in FIG. 1) is arranged to co-operate at the return of the piston 22 to its starting position. Via its end facing the first cylinder part, the gear rack has a carrier arm 26, which extends outward radially. To the second end of the arm 26 there are fastened two cam profiles 26, 27 which are formed with the aid of a cylinder formed rod 28, arranged so that it can slide in relation to a fixed supporting tube 25. The rod 28 has been cut up in its longitudinal direction, and its upper surface formed in this way is divided into two part upper surfaces by means of a groove 28*a* extending in the longitudinal direction (FIG. 3). The part upper surfaces are moreover wavy, and form the cam profiles with which the transfer means described below are to be in contact. The cam profiles vary in the vertical direction along their longitudinal directions and the profile heights obtained control the input on the flow control means so that each profile height corresponds to one speed of the piston. In addition to the varying of the respective cam curve, the cam curves also vary from each other, so that the opening and closing processes for e.g. said screw 2 will be different.

The rod 28 which is arranged so that it can slide in the tube 25 is fastened at its second end to the carrier arm 26 by means of a screw 29 and a nut 30, and in this way the cam profiles will follow the piston rod 22 which is comprised in the cylinder 20. The tube 25 has an end part 31.

The carrier arm 26 is fastened to the piston rod 22 in a way which is known in itself. The cylinder part 21 is made with an envelope groove 21*a* extending in the longitudinal direction of the cylinder, in which groove the carrier arm is displaced when the piston rod of the cylinder part 20 is actuated towards the left in FIG. 2.

In accordance with the FIGS. 4–7, according to the invention the flow control means are to comprise two constant flow valves, the function of which, in principle, is previously well known. Each constant flow valve can be considered to comprise a part for determining the flow quantity and a part for accomplishing the flow.

Figure 4:
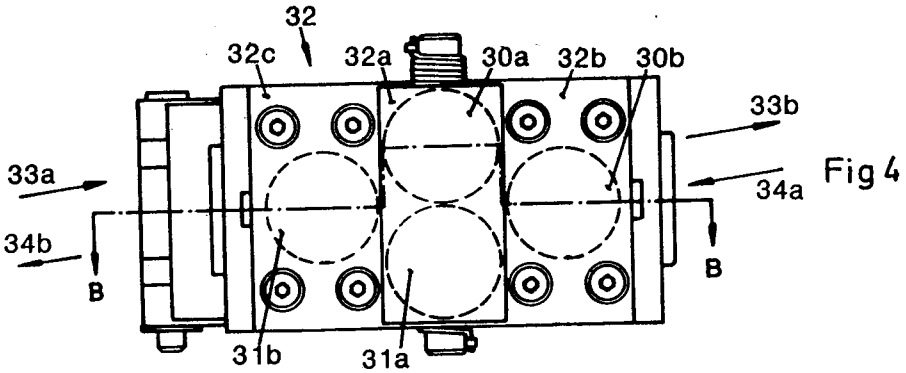
FIG. 4 shows from below the connection of the constant flow valves, FIG. 5 in a cross-section along the section line B—B in FIG. 4 shows the design of the connection along said section line.
Figure 7:
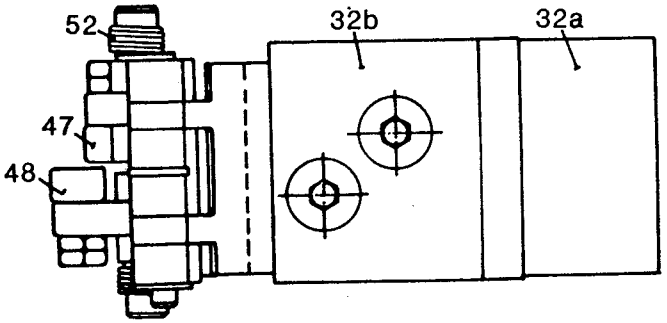
Figure 6:
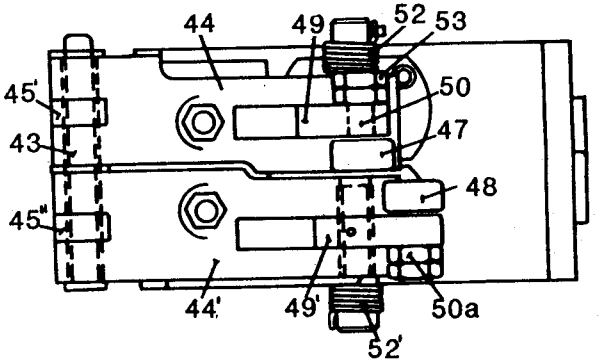
FIG. 6 shows from above the connection according to FIG. 5, and FIG. 7 from one end shows the connection according to FIGS. 5 and 6.

In FIG. 4, the parts for determining the quantity in the constant flow valves are indicated by dash line circles 30*a* and 31*a*, while the parts for accomplishing the flow are indicated by 30*b* and 31*b*, respectively. The parts 30*a* and 30*b* then form the first constant flow valve and the parts 31*a* and 31*b* the second constant flow valve. The parts are contained in a unit 32 which has a middle part 32*a* and two side parts 32*b* and 32*c*. The parts 30*a* and 31*a* are then arranged in the middle part 32*a*, while the parts 30*b* and 31*b* are arranged each in its outer part 32*b* and 32*c*, respectively.

Figure 5:
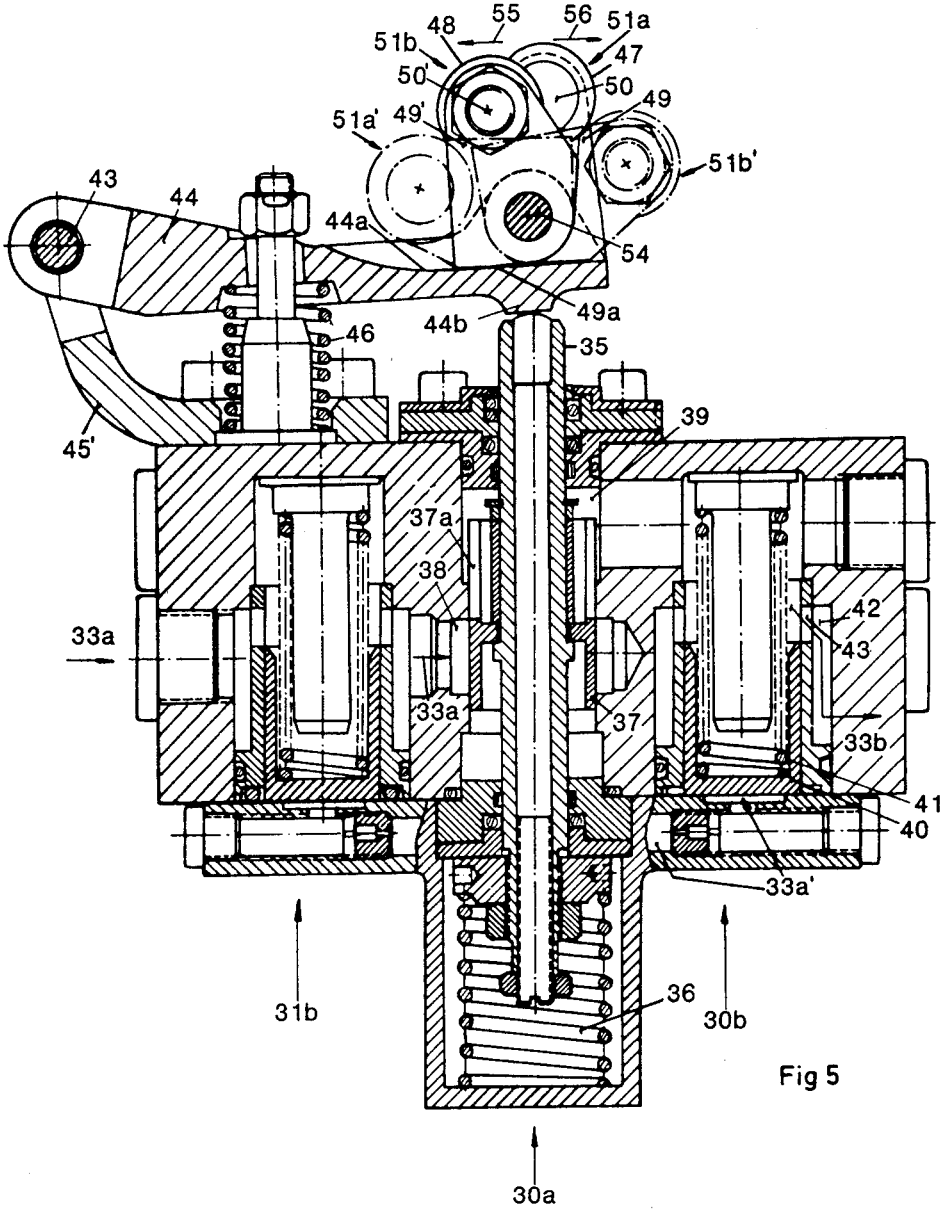

In FIG. 4, a first flow direction for the medium in question is indicated by the input arrow 33*a* and the output arrow 33*b*, and a second flow direction, i.e. the opposite flow direction, is indicated in the corresponding way with input and output arrows 34*a* and 34*b*, respectively. In the first flow direction, the constant flow valve 30*a*, 30*b* is working and in the second flow direction the constant flow valve 31*a*, 31*b*. The parts 30*a* and 31*a*, and 30*b* and 31*b*, respectively, are identical. In FIG. 5, the parts 30*a*, 30*b*, and 31*b* are shown. The part 31*a* is thus entirely identical to the part 30*a*.

In accordance with FIG. 5, the part 30*a* comprises a pin 35 which is arranged so that it can be displaced longitudinally, which can be actuated against the action of a spring 36. To the pin a sleeve 37 is fixed, which serves as a constriction sleeve in connection with an internal channel 38 for the input flow 33*a*. The sleeve 37 has axial grooves 37*a*. When the pin 35 presses the sleeve downwards from the position shown in FIG. 4 the input flow 33*a* can pass into a chamber 39 at the upper parts of the sleeve 37. The quantity of flow which then passes into the chamber 39 is dependent on the degree of longitudinal displacement of the pin 35. The more the pin is pressed down, the greater quantity of flow, and vice versa.

From the chamber 39 the flow is conducted into the part 30*b*, which also has a constriction sleeve 40, which on its inside is actuated by a spring 41 which strives to press the sleeve towards the starting position shown in FIG. 4. The spring force from the spring 41 is added to the pressure of the medium in the input flow in the chamber 39. The pressure of medium and spring force are balanced against the input pressure of medium 33*a*', which is conveyed into the underside of the sleeve 40 where it is allowed to act against the underside of the sleeve. The sleeve 40 controls the quantity of flow which goes out via the output 43, depending on the balancing in question.

It is then characteristic for the constant flow valve described above that at a given degree of longitudinal displacement of the pin 35 at a given quantity of flow is obtained from the output 43 regardless of the load condition for the object, i.e. in this case the hydraulic piston or the hydraulic cylinder which is to be provided with the flow.

If the degree of longitudinal displacement of the pin 35 is changed, also the quantity of flow which goes out will be changed, which will thereafter be constant until a new longitudinal displacement of the pin takes place.

For the sake of clearness, the conducting of the input flow 33*a*' to the underside of the sleeve 40 has not been specially shown in the figure, but can take place in a way which is known in itself, via holes drilled in the unit 32.

At the medium conductor in the second direction 34*a*, 34*b*, i.e. draining from the underside of the piston 6 towards the valve 13 and the tank 17, the function will be identical for the parts 31*a* and 31*b*, and it will therefore not be repeated here.

In accordance with what is stated above, the control input on the unit 32 has two part control inputs which are represented by the pins of the parts 30*a*, 31*a*, which can be displaced longitudinally, and of which only the pin 35 is shown in the figures. Each pin has been allotted one of the cam profiles 26, 27, described above. The transfer of the respective cam profile to the respective pin takes place via transfer means which comprise two arms 44, 44', rotatably supported on a shaft 43.

The shaft 43, in turn, is supported on the upper side of the unit 32 in a bracket with two lugs 45' and 45''. The arms 44, 44' are spring-actuated at their middle parts, each by a spring 46, which presses the arms against the cam profiles. At their second ends the arms support two slip means 47 and 48, which coact with one each of the cam profiles 26, 27. The respective slip means are identical, and are arranged inverted in relation to each other. Thus, the respective slip means comprises a roller which rolls against the respective cam profile. The roller is supported in a link part 49, 49' at its one end. The link part, in turn, is rotatably supported in the second ends of the arms 44, 44', in a journal support 50, 50'. The link part is rotatable between two angular turning positions which are indicated in the figure by 51*a*, 51*a*', and 51*b*, 51*b*', respectively. The end turning position 51*a*, 51*b*, is determined through the coaction of a side surface 49*a* on the link part and a surface 44*a* on the arm 44. The second end turning position is determined by the maximum cam profile height. The link part 49, 49' is moreover actuated by a torsion spring 52 and 52', respectively, which strives to keep the link part 49, 49', in the first-mentioned end turning position 51*a*, 51*b*. FIG. 4 also shows a securing nut 53 which through coaction with threads on a supporting journal 54 on the roller 47 keeps the roller in its position in relation to the link part.

The above-mentioned arrangement for the slip means in question thus functions in the following way. When the cam profile belonging to the slip means, with which the roller is thus in contact through the spring force from the springs 46 and 52, is pulled past the fixed unit 32 in the direction of the arrow 55, the link part 49 is forced to remain in its position 51*b*, due to the friction between the slip means and the cam disc. The link part will then constitute a rigid element, and transfer the cam profile in question to the pin 35, which is displaced longitudinally in dependence on the cam profile. The coaction between the arm 44 and the pin 35 takes place via a cleat 44*b* arranged on the underside of the arm, at the second end of this, and the upper end of the pin.

However, if the cam profile is moved past the unit 32 in the opposite direction, which is indicated by the arrow 56, the link 49 will be able to turn in the support 50 against the action of the torsion spring 52. This turning takes place in dependence on the cam profile and in relation to the arm 44. Further, the counter-holding spring 36 of the pin 35 is chosen so that the pin will not be actuated by the last-mentioned turning movement of the link part. Moreover, the maximum turning angle of the link part has been chosen so that it exceeds the maximum longitudinal displacement movement of the pin 35, i.e. in the direction 56 of the cam profile this will not be able to actuate said pin via the transfer means.

The slip means 48 is made in an identical way, but arranged as an inverted image, so that it instead achieves the transfer from its cam profile to the pin belonging to it in the direction of the arrow 56, while on the contrary the transfer does not take place when the cam profile in question is pulled in the direction of the arrow 55. The above thus requires that the cam disc 26 controls the flow control means in the first direction of the hydraulic piston and the cam disc 27 controls the flow control means in the second direction of the hydraulic piston, or vice versa.

The invention is not limited to the embodiment shown above as an example, but can be subject to modifications within the scope of the following claims, and the concept of the invention.

INDUSTRIAL APPLICABILITY

The parts concerned by the invention are suitable for assembly in efficient manufacture at a factory or the like. The parts according to the invention can easily be integrated in the connection in question, e.g. in connection with firearms in the form of artillery pieces or the like, to which the invention can be integrated both in connection with new manufacture or as a complement to already existing weapon equipment.

I claim:

1. A device for controlling the motion of a hydraulic piston of a piston cylinder assembly comprising:

first and second constant flow valves connected to provide first and second hydraulic fluid flow paths for said piston cylinder assembly, said flow valves each having a pin longitudinally displaceable against a spring whereby displacement of said pin controls fluid flow;

cam means providing first and second cam profiles for actuating first and second of said pins, said cam means connected to move in response to relative movement between said piston and cylinder;

first and second arms each rotatably supported at one end, the underside of said arms contacting one of said pins;

first and second link parts rotatably connected to a remaining end of said first and second arms, said link parts being spring biased in a first angular position, against a respective arm, and displaceable to a second angular position with respect to said arm;

a roller connected on an end of each link part and in contact with a respective cam profile;

a spring biasing said arms whereby respectively connected rollers are urged against one of said cam profiles whereby said cam profile in a first direction of movement forces said link part against said first angular position displacing a respective arm and contacting pin, and in an opposite direction forces said roller and link member to be angularly displaced with respect to an attached arm inhibiting displacement of said pin.

2. A device according to claim 1 further comprising a direction valve which can be actuated by the piston which selects the inputs and outputs for controlling the direction of movement between the piston and cylinder.

3. A device according to claim 1, wherein the cam profiles consist of part upper surfaces of a rod which is slit in its longitudinal direction, the part upper surfaces being separated by a dividing groove extending in the longitudinal direction of the rod.

4. A device according to claim 1 wherein, the respective constant flow valves comprise: a part for determining the quantity of flow, and a part for accomplishing the flow, and a unit forming a flow control means is made with a middle part which comprises the parts determining the quantity of flow of the two constant flow valves and side parts which each include a part for accomplishing the flow.

5. In a firearm having a closing mechanism operable between an open and closed position, said closing mechanism operating in response to the relative motion produced by a piston cylinder assembly, a device for controlling said relative motion comprising:

first and second constant flow valves connected to provide first and second hydraulic fluid flow paths for said piston cylinder assembly, said flow valves each having a pin longitudinally displaceable against a spring whereby displacement of said pin controls fluid flow;

cam means providing first and second cam profiles for actuating first and second of said pins, said cam means connected to move in response to relative movement between said piston and cylinder;

first and second arms each rotatably supported at one end, the underside of said arms contacting one of said pins;

first and second link parts rotatably connected to a remaining end of said first and second arms, said link parts being spring biased in a first angular position, against a respective arm, and displaceable to a second angular position with respect to said arm;

a roller connected on an end of each link part and in contact with a respective cam profile;

a spring biasing said arms whereby respectively connected rollers are urged against one of said cam profiles whereby said cam profiles in a first direction of movement forces said link part against said first angular position displacing a respective arm and contacting pin, and in an opposite direction forces said roller and link member to be angularly displaced with respect to an attached arm inhibiting displacement of said pin.

* * * * *